US008867770B2

(12) United States Patent
Chien et al.

(10) Patent No.: US 8,867,770 B2
(45) Date of Patent: Oct. 21, 2014

(54) SPEAKER-CONNECTOR MODULE AND HANDHELD ELECTRONIC DEVICE

(75) Inventors: Chih-Ling Chien, Taoyuan County (TW); Chien-Hsin Huang, Taoyuan County (TW); Tsung-Yuan Ou, Taoyuan County (TW); Chen-Yu Wang, Taoyuan County (TW)

(73) Assignee: HTC Corporation, Taoyuan County (TW)

( * ) Notice: Subject to any disclaimer, the term of this patent is extended or adjusted under 35 U.S.C. 154(b) by 355 days.

(21) Appl. No.: 13/332,396

(22) Filed: Dec. 21, 2011

(65) Prior Publication Data

US 2013/0070947 A1 Mar. 21, 2013

Related U.S. Application Data

(60) Provisional application No. 61/536,068, filed on Sep. 19, 2011.

(51) Int. Cl.
*H04R 1/02* (2006.01)
*H04R 1/28* (2006.01)

(52) U.S. Cl.
CPC ..... *H04R 1/2803* (2013.01); *H04R 2499/11* (2013.01); *H04R 1/2896* (2013.01)
USPC ..... 381/332; 381/89; 381/338; 381/165; 381/303; 455/575.1

(58) Field of Classification Search
CPC ..... H04R 5/02; H04R 2205/021; H04R 2205/024; H04R 2201/02; H04R 2201/023; H04R 2201/025; H04R 2201/029; H04R 2201/34; H04R 1/02; H04R 1/021; H04R 1/025; H04R 1/026; H04R 1/227; H04R 1/28; H04R 1/2803; H04R 1/2807; H04R 1/2811; H04R 1/2819; H04R 1/2823; H04R 1/2846; H04R 1/2869; H04R 1/2884; H04R 1/2892; H04R 1/2896; H04R 1/32; H04R 1/323; H04R 1/34; H04R 1/345; H04R 1/36; H04R 1/38; H04R 1/023; H04R 1/403
USPC ..... 381/89, 332, 334, 336, 337, 338, 339, 381/165, 385, 386, 387, 389, 395, 189, 431, 381/300, 301, 302, 303, 61, 59; 181/199; 455/575.1, 575.9, 575.8, 569.1
See application file for complete search history.

(56) References Cited

U.S. PATENT DOCUMENTS

| | | | | |
|---|---|---|---|---|
| 5,805,708 | A * | 9/1998 | Freadman | 381/345 |
| 2004/0081325 | A1* | 4/2004 | Rautio et al. | 381/189 |
| 2010/0216526 | A1* | 8/2010 | Chen et al. | 455/575.1 |

FOREIGN PATENT DOCUMENTS

| | | |
|---|---|---|
| CN | 1943268 | 4/2007 |

OTHER PUBLICATIONS

"Office Action of China Counterpart Application", issued on Sep. 2, 2014, p. 1-9.

*Primary Examiner* — Leshui Zhang
(74) *Attorney, Agent, or Firm* — Jianq Chyun IP Office

(57) ABSTRACT

The disclosure provides a speaker-connector module and a handheld electronic device. The handheld electronic device includes a body and a speaker-connector module. The body has an opening. The speaker-connector module is assembled in the body and correspondingly disposed to the opening. The speaker-connector module includes a housing, a speaker and an electrical connector. The housing has a major sound passage, wherein the major sound passage has a major input end and a major output end. The speaker is assembled in the housing and has a sound outlet surface, wherein the major input end is communicated with the sound outlet surface. The electrical connector is disposed in the major sound passage and adjacent to the speaker, and the major input end is connected to the electrical connector.

22 Claims, 7 Drawing Sheets

SPEAKER-CONNECTOR MODULE AND HANDHELD ELECTRONIC DEVICE

CROSS-REFERENCE TO RELATED APPLICATION

This application claims the priority benefits of U.S. provisional application Ser. No. 61/536,068, filed on Sep. 19, 2011. The entirety of the above-mentioned patent application is hereby incorporated by reference herein and made a part of this specification.

BACKGROUND OF THE DISCLOSURE

1. Technical Field

The present disclosure relates to a connector module and a handheld electronic device. More particularly, the present disclosure relates to a speaker-connector module and a handheld electronic device using the same.

2. Background

In current information era, human beings by degrees tend to rely on products like handheld electronic devices. The electronic products such as mobile phones, multi-media players, tablet computers, handheld game consoles, handheld global positioning system (GPS) and the like have pervaded everywhere in our daily life. Thus, those handheld electronic devices have become inseparable from people's daily lives. Taking the mobile phones as an example, in current market, many types of handheld electronic devices may be seen. In addition to bar-type handheld phones in which the operating interface and the display screen are coplanar and folding-type handheld phones in which the operating interface may be folded related to the display screen, sliding-type handheld phones in which the operating interface may slide related to the display screen are commonly seen.

Regardless of the type, every type of mobile phone is disposed speakers thereon so as to perform phone calls or function of loud speaker. In general, a plurality of meshes may have been disposed on the body of mobile phone, and the speaker corresponds to those meshes, in order to transmit the sound generated by the speaker through the meshes. However, the configuration of meshes might destroy the ornamental appearance of the mobile phone.

SUMMARY

The present disclosure provides a speaker-connector module including a major sound passage, wherein the major sound passage is connected to a speaker, and an electrical connector is disposed in the major sound passage so that the sound generated by the speaker may be transmitted through the major sound passage and broadcasted from the electrical connector.

The present disclosure provides a handheld electronic device including the speaker-connector module so that the sound generated by the speaker may be transmitted through the major sound passage and broadcasted from an opening of a body.

The present disclosure provides a speaker-connector module adapted to a handheld electronic device. The speaker-connector module includes a housing, a speaker and an electrical connector. The housing has a major sound passage, wherein the major sound passage has a major input end and a major output end. The speaker is assembled in the housing and has a sound outlet surface, wherein the major input end is communicated with the sound outlet surface. The electrical connector is disposed in the major sound passage.

The present disclosure provides an handheld electronic device including a body and a speaker-connector module. The body has an opening. The speaker-connector module is assembled in the body and correspondingly disposed to the opening. The speaker-connector module includes a housing, a speaker and an electrical connector. The housing has a major sound passage, wherein the major sound passage has a major input end and a major output end. The speaker is assembled in the housing and has a sound outlet surface, wherein the major input end is communicated with the sound outlet surface. The electrical connector is disposed in the major sound passage.

In light of the above, in the speaker-connector module of the present disclosure, the housing has a major sound passage, and the major sound passage is connected to the speaker, and the electrical connector is disposed in the major sound passage. Accordingly, the sound generated by the speaker may be transmitted through the major sound passage and broadcasted from the electrical connector, the quantity of sound outlet holes may be reduced in the application of the speaker-connector module of the handheld electronic device, so as to keep the appearance of the handheld electronic device.

Several exemplary embodiments accompanied with figures are described in detail below to further describe the disclosure in details.

BRIEF DESCRIPTION OF THE DRAWINGS

The accompanying drawings constituting a part of this specification are incorporated herein to provide a further understanding of the disclosure. Here, the drawings illustrate embodiments of the disclosure and, together with the description, serve to explain the principles of the disclosure.

DESCRIPTION OF EMBODIMENTS

Figure 1:
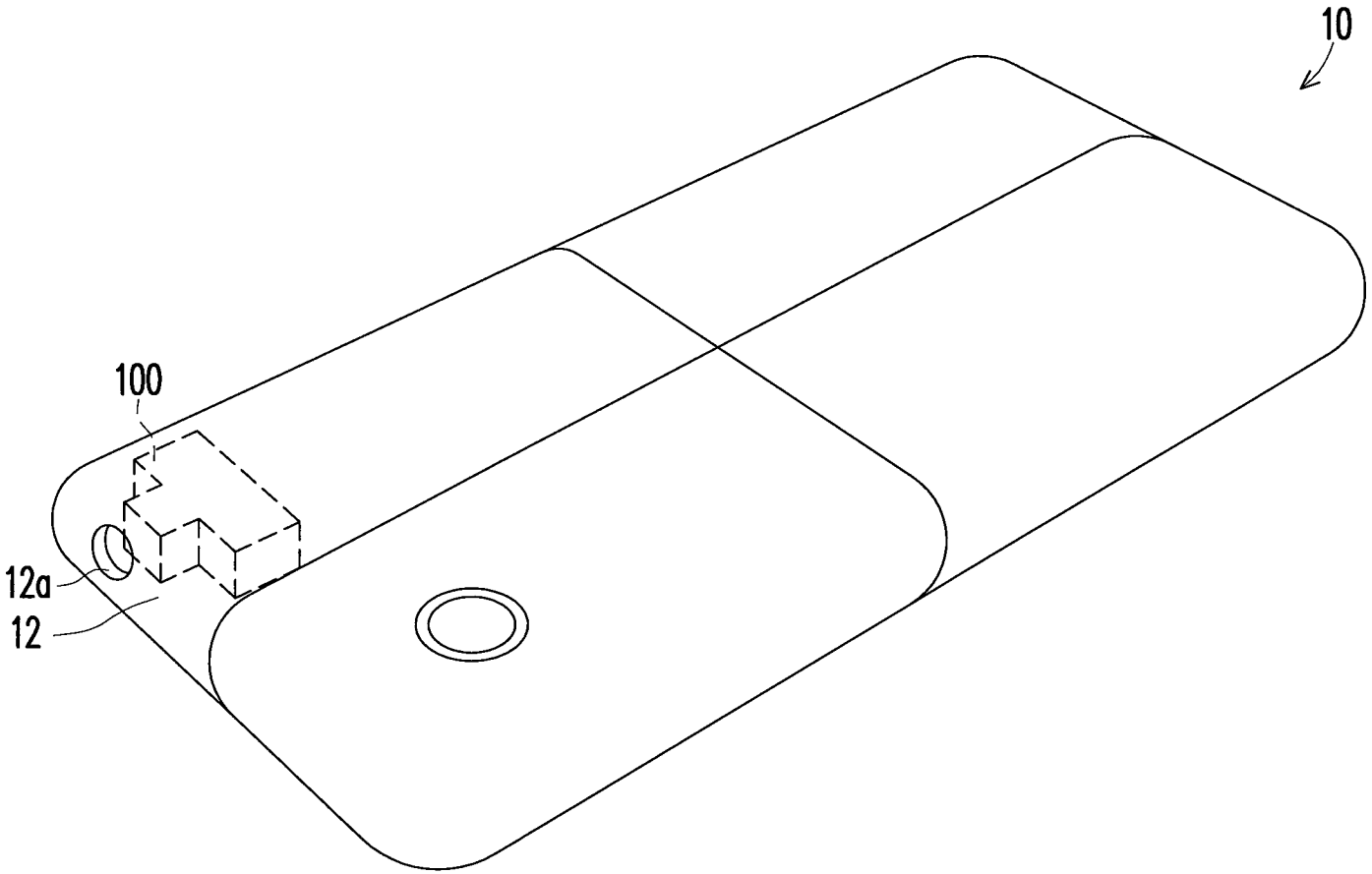
FIG. 1 is a perspective view of a handheld electronic device according to one embodiment of the present disclosure.

FIG. 1 is a perspective view of a handheld electronic device according to one embodiment of the present disclosure. Referring to FIG. 1, in the present disclosure, the handheld electronic device 10 includes a body 12 and a speaker-connector module 100. The body 12 has an opening 12*a*. The speaker-connector module 100 is assembled in the body 12. In addition, the handheld electronic device 10 may be a mobile phone, a tablet computer, a multi-media player, a handheld game console or a handheld global positioning system (GPS), for example. In the embodiment, the handheld electronic device 10 is a mobile phone.

Figure 2:
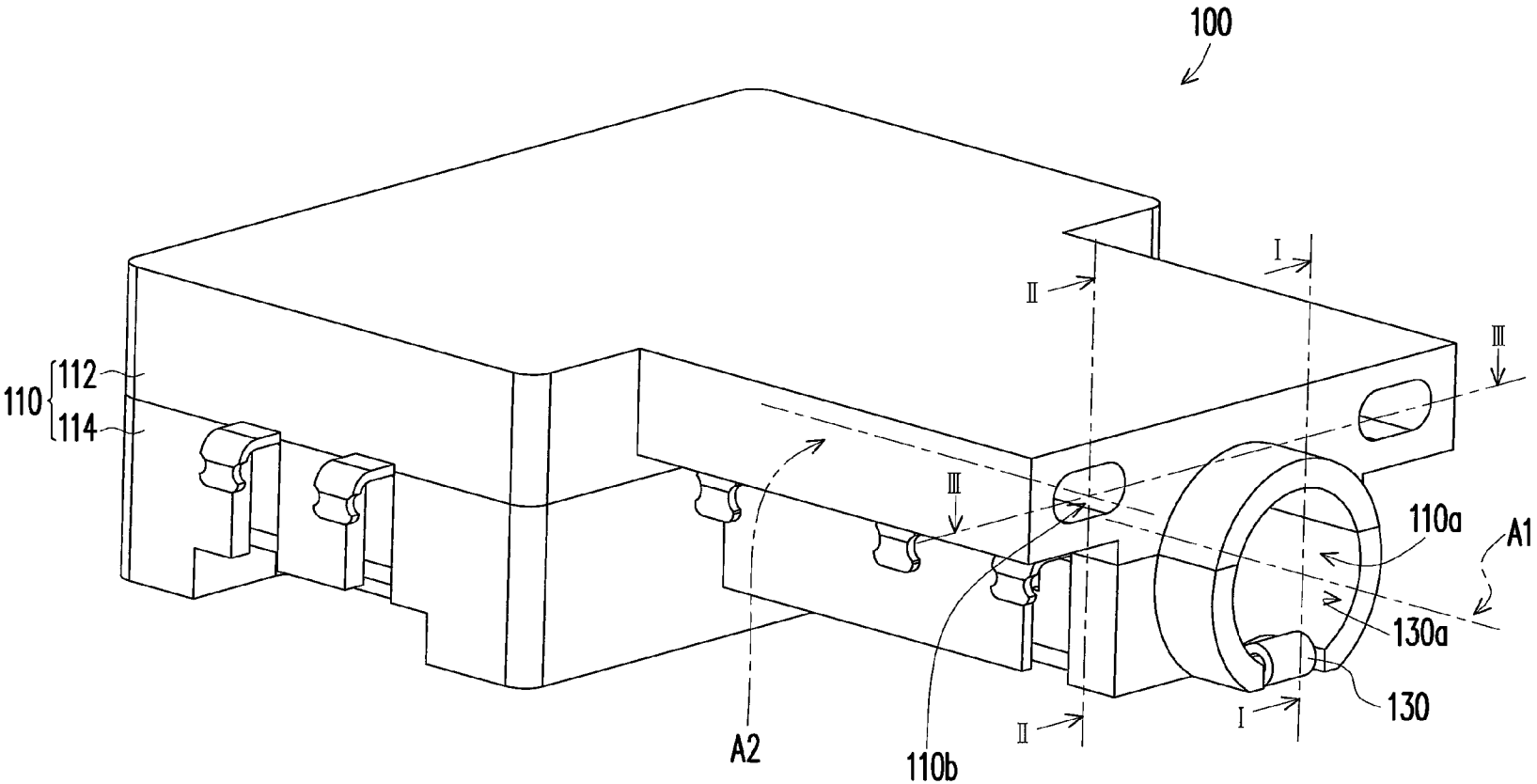
FIG. 2 is a perspective view of the speaker-connector module of FIG. 1.
Figure 3:
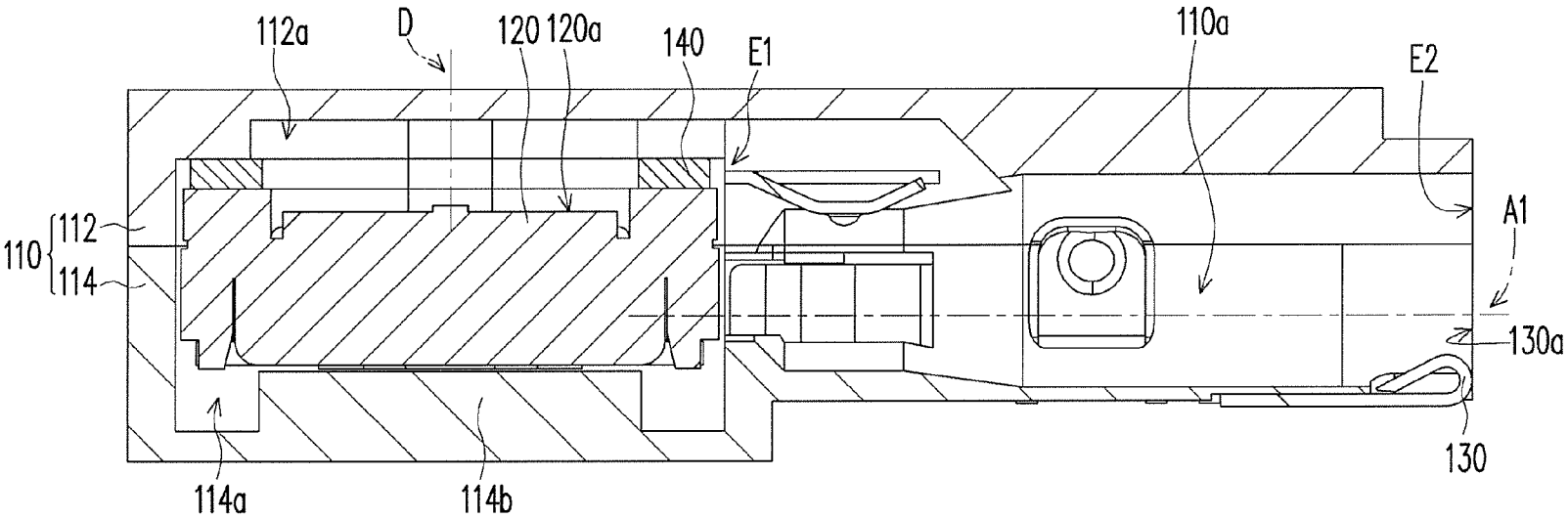
FIG. 3 is a cross-sectional view along a sectional line I-I of the housing of FIG. 2.
Figure 4:
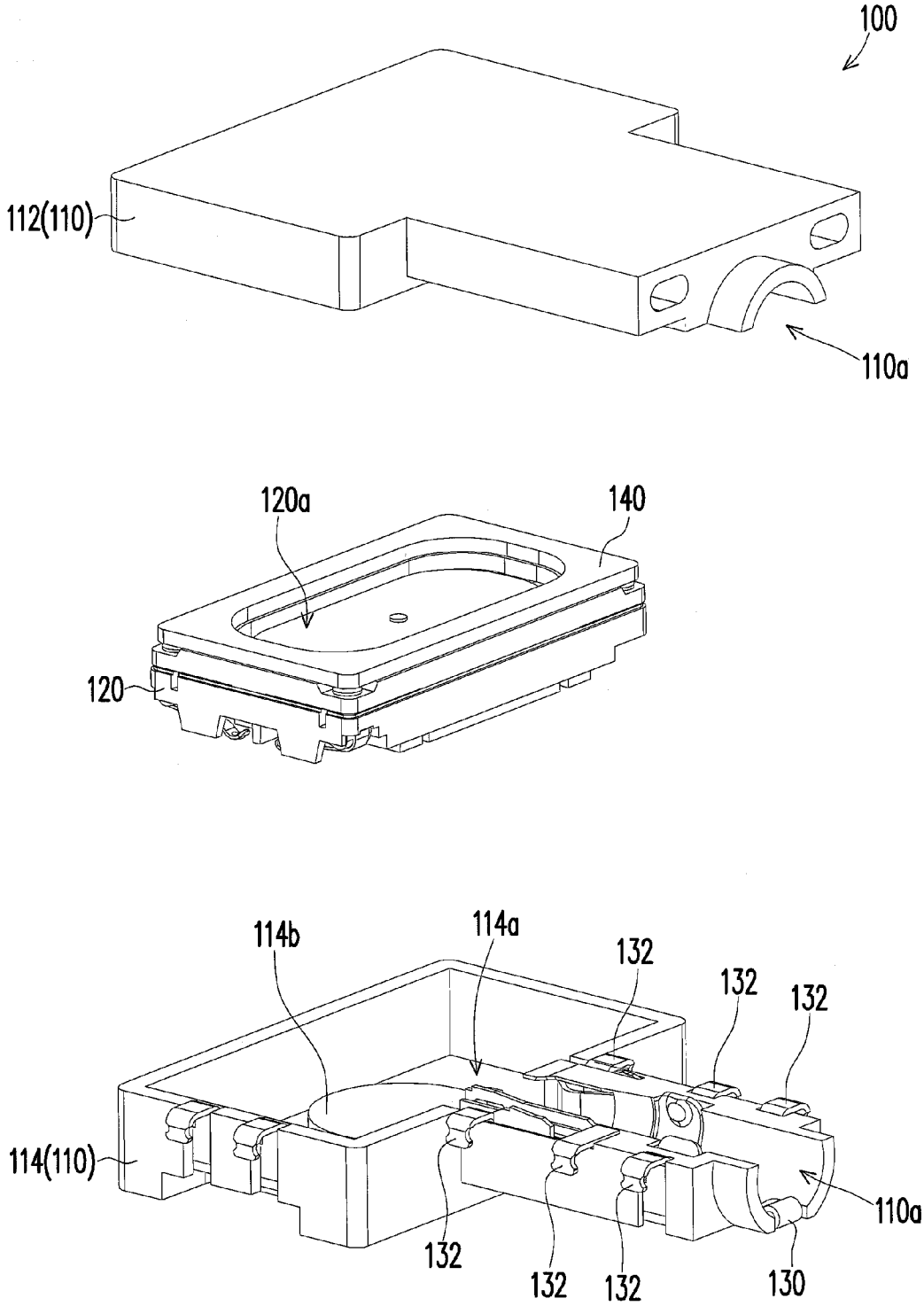
FIG. 4 is an exploded view of the speaker-connector module of FIG. 2.

FIG. 2 is a perspective view of the speaker-connector module of FIG. 1. FIG. 3 is a cross-sectional view along a sectional line I-I of the housing of FIG. 2. FIG. 4 is an exploded view of the speaker-connector module of FIG. 2. Referring to FIG. 2, FIG. 3 and FIG. 4, the speaker-connector module 100 includes a housing 110, a speaker 120 and an electrical connector 130. The housing 110 has a major sound passage 110*a*, wherein the major sound passage 110*a* has a major input end E1 and a major output end E2, and the major output end E2 is correspondingly disposed at the location of the opening 12*a* (shown in FIG. 1). In addition, an electric plug (not shown) may be inserted into the major sound passage 110*a* through the opening 12*a* (shown in FIG. 1) so as to electrically connect to the electrical connector 130. The speaker 120 is assembled in the housing 110 and has a sound outlet surface 120*a*, wherein the major input end E1 is communicated with the sound outlet surface 120*a*. The electrical connector 130 is disposed in the major sound passage 110*a* and adjacent to the speaker 120, and the major output end E2 is connected to the electrical connector 130. Therefore, when the speaker 120 generates a sound, the sound comes out from the sound outlet surface 120*a* and is transmitted between the major input end E1 and the major output end E2 of the major sound passage 110*a*, and finally the sound is broadcasted from the inserting hole 130*a* of the electrical connector 130 and the opening 12*a* (shown in FIG. 1) of the body 12 (shown in FIG. 1). Accordingly, the sound generated by the speaker 120 may be transmitted through the major sound passage 110*a* and broadcasted from the electrical connector 130, thus the quantity of sound outlet holes may further be reduced in the handheld electronic device 10 in which the speaker-connector module 100 is used, so as to keep the appearance of the handheld electronic device 10.

Referring to FIG. 3 and FIG. 4, the housing 110 of the embodiment further has an upper sound box 112*a* located above the sound outlet surface 120*a*. The upper sound box 112*a* is communicated with the major input end E1 so that the upper sound box 112*a* may be an open space for enhancing the quality of high frequency sound of the speaker 120. More specifically, the housing 110 includes an upper cover 112 and a lower cover 114. The upper cover 112 has the upper sound box 112*a*, wherein the speaker 120 and the electrical connector 130 are disposed between the upper cover 112 and the lower cover 114. Moreover, the housing 110 may further have both of the upper sound box 112*a* and a lower sound box 114*a*. The speaker 120 is located between the upper sound box 112*a* and the lower sound box 114, and the lower sound box 114*a* is located below the sound outlet surface 120*a*. The lower cover 114 has the lower sound box 114*a*, and a protruding portion 114*b* of the lower cover 114 leans against to the bottom of the speaker 120, so that the lower sound box 114*a* may be a closed space for enhancing the quality of low frequency sound of the speaker 120.

The speaker-connector module 100 of the embodiment further includes a sound insulation foam 140 disposed on the speaker 120 and surrounding the sound outlet surface 120*a*. According to such configuration, the sound outlet of the speaker 120 may be more concentrated, and it facilitates users to hear clearer and understand what they heard.

Figure 5:
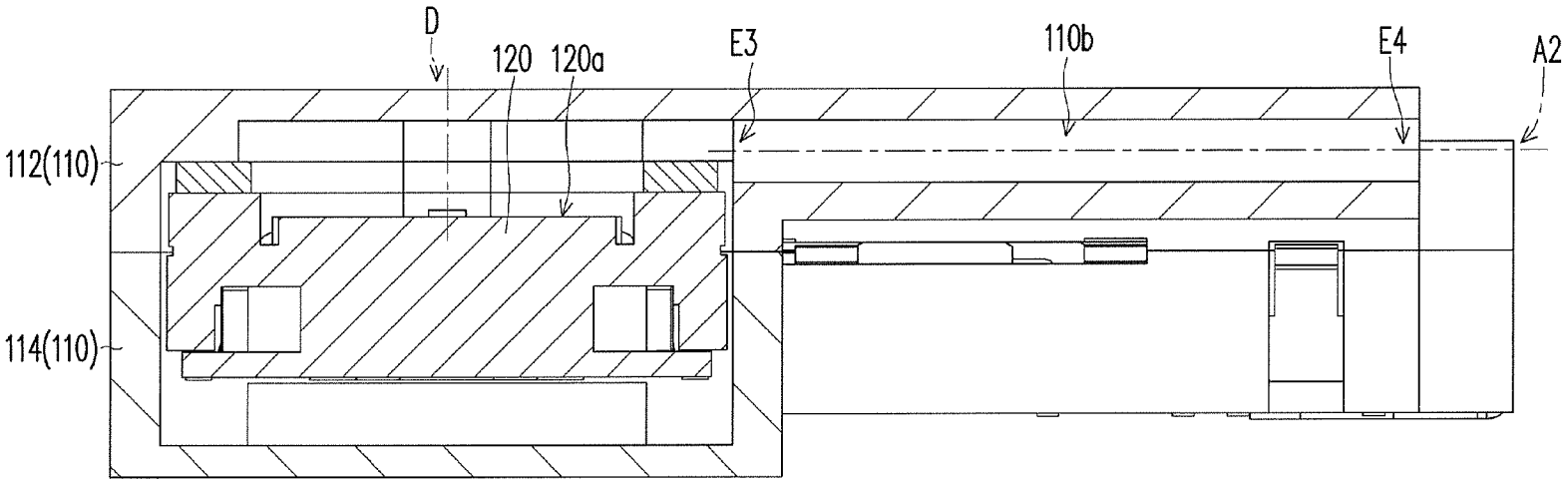
FIG. 5 is a cross-sectional view along a sectional line II-II of the housing of FIG. 2.
Figure 6:
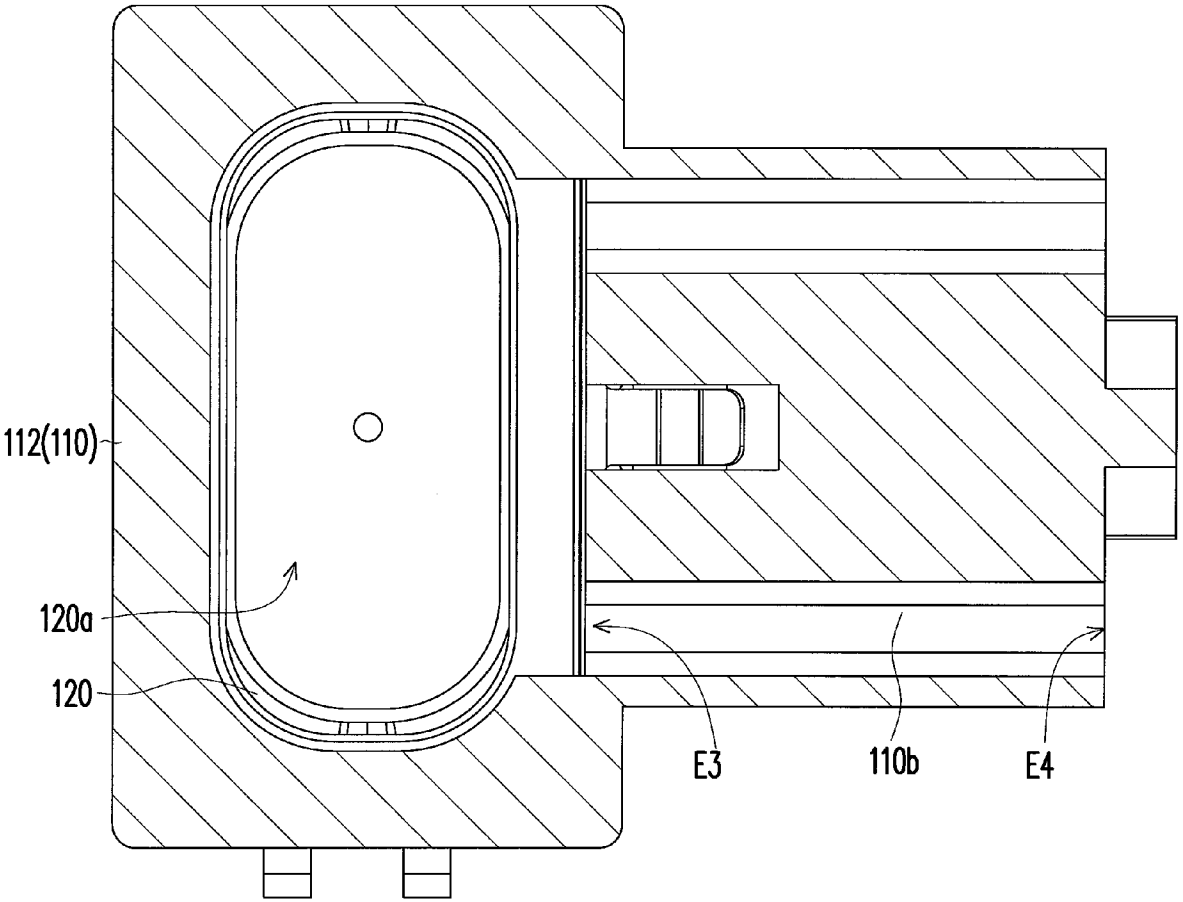
FIG. 6 is a cross-sectional view along a sectional line III-III of the housing of FIG. 2.

FIG. 5 is a cross-sectional view along a sectional line II-II of the housing of FIG. 2. FIG. 6 is a cross-sectional view along a sectional line III-III of the housing of FIG. 2. Referring to FIG. 2, FIG. 5 and FIG. 6, the housing 110 of the embodiment further has a minor sound passage 110*b* disposed at a side of the major sound passage 110*a*. The minor sound passage 110*b* has a minor input end E3 and a minor output end E4, and the minor input end E3 is communicated with the sound outlet surface 120*a*. Accordingly, the sound generated by the speaker 120 may be transmitted through a plurality of sound passages (e.g., the major sound passage 110*a* and the minor sound passage 110*b*), so as to increase sound outlet regions and to further improve the quality of sound outlet. Additionally, when the major sound passage 110*a* is inserted by an electric plug, the sound generated by the speaker 120 may be impeded to be transmitted and the volume and quality of sound outlet may be decreased. Thus, the configuration of the minor sound passage 110*b* may maintain the volume and quality of the sound outlet.

Referring to FIG. 2, FIG. 3 and FIG. 5, an extending axis A1 of the major sound passage 110*a* is perpendicular to a normal direction D of the sound outlet surface 120*a*. Accordingly, the whole thickness of the speaker-connector module 100 may be reduced and thus miniaturization of the handheld electronic device 10 may be realized. Furthermore, an extending axis A2 of the minor sound passage 110*b* is perpendicular to the normal direction D of the sound outlet surface 120*a*, and thus it facilitates miniaturization of the handheld electronic device 10.

Referring to FIG. 4, the electrical connector 130 has a plurality of terminals 132 disposed in the major sound passage 110*a*, wherein the electrical connector 130 may be an audio jack, for example, capable of connecting to earphones (not shown) or another speaker (not shown).

Figure 7:
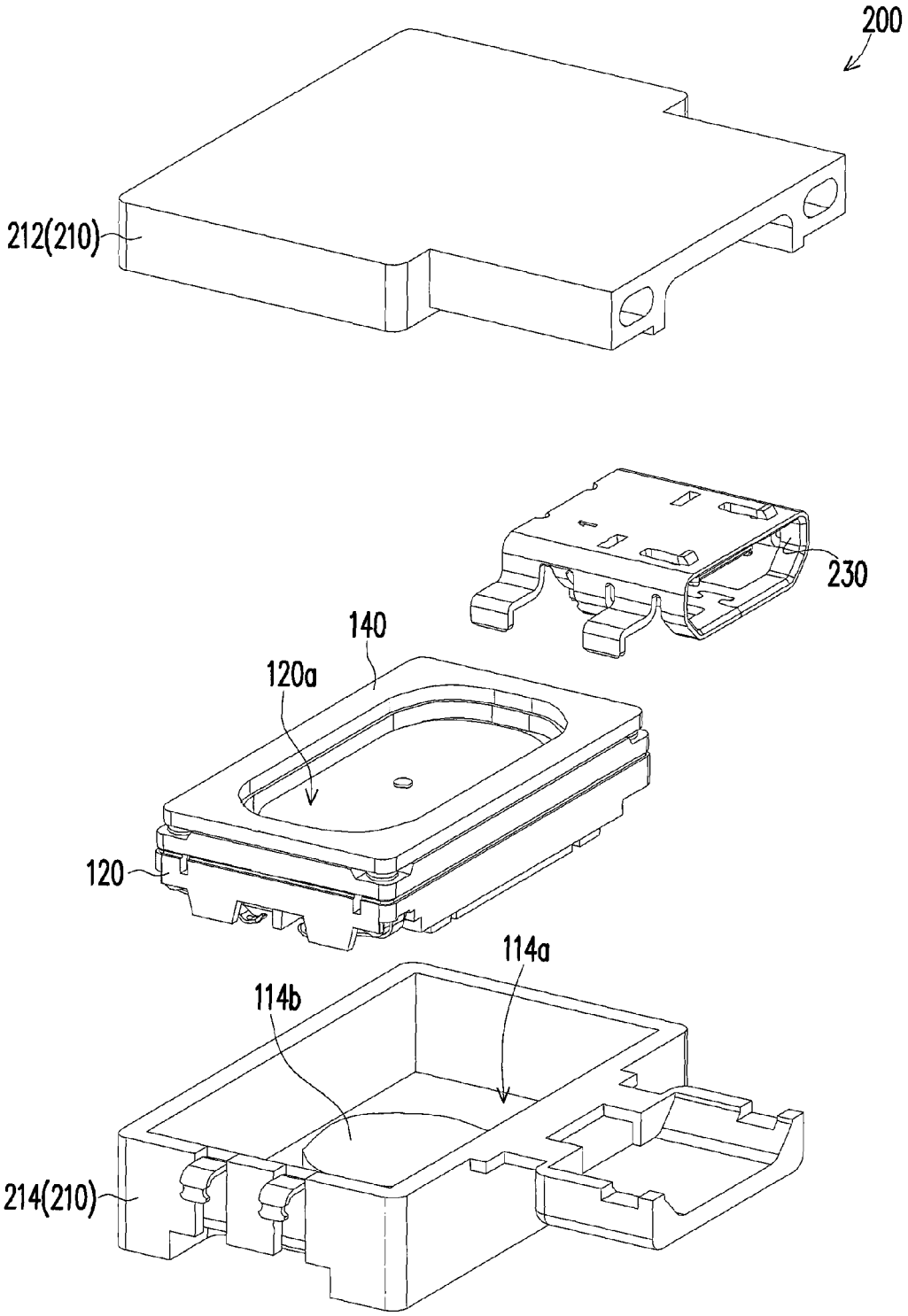
FIG. 7 is an exploded view of a speaker-connector module according to another embodiment of the present disclosure.

FIG. 7 is an exploded view of a speaker-connector module according to another embodiment of the present disclosure. It has to be noted that, the speaker-connector module 200 of FIG. 7 is similar to the speaker-connector module 100 of FIG. 4, wherein elements having identical or similar functions and structures are assigned with the same reference numbers and terms for consistency, and it is not repeated herein. Referring to FIG. 4 and FIG. 7, in the embodiment, an electrical connector 230 may be a universal serial bus (USB) socket, for example, and the electrical connector 230 is disposed between an upper cover 212 and a lower cover 214 of a housing 210. After the electric plug is inserted into the electrical connector 230, it may be connected to another electronic device.

In light of the foregoing, in the speaker-connector module of the present disclosure, the housing has a major sound passage, and the major sound passage is connected to the speaker, and the electrical connector is disposed in the major sound passage. Accordingly, the sound generated by the speaker may be transmitted through the major sound passage and broadcasted from the electrical connector, thus the quantity of sound outlet holes may further be reduced in the handheld electronic device in which the speaker-connector module is used, so as to keep the appearance of the handheld electronic device. Furthermore, since the speaker-connector module further includes the sound insulation foam, the sound outlet of the speaker may be more concentrated, and it facilitates users to hear clearer and understand what they heard. In addition, the housing of the speaker-connector module further has the minor sound passage to increase the sound outlet region and the volume and quality of sound outlet may further be improved. Additionally, the extending axis of the major sound passage may be perpendicular to the normal direction of the sound outlet surface, and thus the whole thickness of the speaker-connector module may be reduced and it facilitates the miniaturization of the handheld electronic device.

It will be apparent to those skilled in the art that various modifications and variations may be made to the structure of the disclosure without departing from the scope or spirit of the disclosure. In view of the foregoing, it is intended that the disclosure cover modifications and variations of this disclosure provided they fall within the scope of the following claims and their equivalents.

What is claimed is:

1. A speaker-connector module adapted to a handheld electronic device, the speaker-connector module comprising:

a housing having a major sound passage, wherein the major sound passage has a major input end and a major output end;

a speaker assembled in the housing and having a sound outlet surface, wherein the major input end is communicated with the sound outlet surface; and an electrical connector disposed in the major sound passage, wherein the housing further has a minor sound passage disposed at a side of the major sound passage and parallel to the major sound passage, the major sound passage and the minor sound passage are above the sound outlet surface, the minor sound passage has a minor input end and a minor output end, and the minor input end is communicated with the sound outlet surface.

2. The speaker-connector module as claimed in claim 1, wherein the housing further has an upper sound box, and the upper sound box is located above the sound outlet surface.

3. The speaker-connector module as claimed in claim 2, wherein the housing comprises:

an upper cover having the upper sound box; and a lower cover, wherein the speaker and the electrical connector are disposed between the upper cover and the lower cover.

4. The speaker-connector module as claimed in claim 1, wherein the housing further has an upper sound box and a lower sound box, and the speaker is located between the upper sound box and the lower sound box, and the upper sound box is located above the sound outlet surface.

5. The speaker-connector module as claimed in claim 4, wherein the housing comprises:

an upper cover having the upper sound box; and a lower cover having the lower sound box, wherein the speaker and the electrical connector are disposed between the upper cover and the lower cover.

6. The speaker-connector module as claimed in claim 1, wherein the electrical connector has a plurality of terminals, and the terminals are disposed in the major sound passage.

7. The speaker-connector module as claimed in claim 1, further comprising:

a sound insulation foam disposed on the speaker and surrounding the sound outlet surface.

8. The speaker-connector module as claimed in claim 1, wherein an extending axis of the major sound passage is perpendicular to a normal direction of the sound outlet surface, the major input end and the major output end are located at the extending axis, and the major output end corresponds to an opening of the handheld electronic device.

9. The speaker-connector module as claimed in claim 1, wherein an extending axis of the minor sound passage is perpendicular to a normal direction of the sound outlet surface, the minor input end and the minor output end are located at the extending axis of the minor sound passage.

10. The speaker-connector module as claimed in claim 1, wherein the electrical connector is an audio jack.

11. The speaker-connector module as claimed in claim 1, wherein the electrical connector is a universal serial bus (USB) socket.

12. A handheld electronic device, comprising:

a body having an opening; and a speaker-connector module assembled in the body, the speaker-connector module comprising:

a housing having a major sound passage, wherein the major sound passage has a major input end and a major output end, and the major output end corresponds to the opening;

a speaker assembled in the housing and having a sound outlet surface, wherein the major input end is communicated with the sound outlet surface; and an electrical connector disposed in the major sound passage, wherein the housing further has a minor sound passage disposed at a side of the major sound passage and parallel to the major sound passage, the major sound passage and the minor sound passage are above the sound outlet surface, the minor sound passage has a minor input end and a minor output end, and the minor input end is communicated with the sound outlet surface.

13. The handheld electronic device as claimed in claim 12, wherein the housing further has an upper sound box, and the upper sound box is located above the sound outlet surface.

14. The handheld electronic device as claimed in claim 13, wherein the housing comprises:

an upper cover having the upper sound box; and a lower cover, wherein the speaker and the electrical connector are disposed between the upper cover and the lower cover.

15. The handheld electronic device as claimed in claim 12, wherein the housing further has an upper sound box and a lower sound box, and the speaker is located between the upper sound box and the lower sound box, and the upper sound box is located above the sound outlet surface.

16. The handheld electronic device as claimed in claim 15, wherein the housing comprises:

an upper cover having the upper sound box; and a lower cover having the lower sound box, wherein the speaker and the electrical connector are disposed between the upper cover and the lower cover.

17. The handheld electronic device as claimed in claim 12, wherein the electrical connector has a plurality of terminals, and the terminals are disposed in the major sound passage.

18. The handheld electronic device as claimed in claim 12, wherein the speaker-connector module further comprises a sound insulation foam disposed on the speaker and surrounding the sound outlet surface.

19. The handheld electronic device as claimed in claim 12, wherein an extending axis of the major sound passage is perpendicular to a normal direction of the sound outlet surface, the major input end and the major output end are located at the extending axis.

20. The handheld electronic device as claimed in claim 12, wherein an extending axis of the minor sound passage is perpendicular to a normal direction of the sound outlet surface, the minor input end and the minor output end are located at the extending axis of the minor sound passage.

21. The handheld electronic device as claimed in claim 12, wherein he electronic connector is an audio jack.

22. The handheld electronic device as claimed in claim 12, wherein the electrical connector is a universal serial bus (USB) socket.

* * * * *